US006146197A

United States Patent [19]

Holliday et al.

[11] Patent Number: 6,146,197

[45] Date of Patent: Nov. 14, 2000

[54] WATERTIGHT END CONNECTOR FOR COAXIAL CABLE

[76] Inventors: Randall A. Holliday, 10045 Meade, Count Westminster, Colo. 80030; Shen-Chia Wong, No. 10 Lane 121, Li-Der Road, Peito District Taipei, Taiwan

[21] Appl. No.: 09/032,771

[22] Filed: Feb. 28, 1998

[51] Int. Cl.[7] ..... H01R 9/05

[52] U.S. Cl. ..... 439/585

[58] Field of Search ..... 439/578, 584, 439/585; 174/89, 90

[56] References Cited

U.S. PATENT DOCUMENTS

| | | | |
|---|---|---|---|
| 3,710,005 | 1/1973 | French | 174/89 |
| 5,002,503 | 3/1991 | Campbell et al. | 439/578 |
| 5,667,405 | 9/1997 | Holliday | 439/585 |
| 5,866,849 | 2/1999 | Tuvy et al. | 174/74 A |

*Primary Examiner*—Steven L. Stephan
*Assistant Examiner*—Barry M. L. Standig
*Attorney, Agent, or Firm*—Pro-Techtor International Services

[57] ABSTRACT

An end connector for coaxial cable which is composed of a thimble, an outer sleeve, a grip nut and a taper jacket; wherein the thimble having a first flange and a first extension part. The outer sleeve is installed outside of the thimble and has a body and a second extension part, between the first extension part and the second extension part can form a cylindrical cavity, furthermore, the inner circumference of the second extension part having a plurality of engaging teeth for engaging the outer layer of a coaxial cable. The end of this end connector for coaxial cable is fitted with the grip nut in which having female treads for connecting with a receiver or a terminal station. The taper jacket is installed on the second extension part of the outer sleeve, this taper jacket having a taper hole formed therein. As the operator presses the taper jacket downwardly, the taper hole will press the outer sleeve to make the second extension part form a conical shape for firmly clamping a coaxial cable, such that, the end connector for coaxial cable can be made water tight.

2 Claims, 9 Drawing Sheets

WATERTIGHT END CONNECTOR FOR COAXIAL CABLE

BACKGROUND OF THE INVENTION (1) Field of the Invention

This invention relates to a end connector coaxial cable for connecting to specific device, such as TV receiver or terminal station, especially a end connector coaxial for cable which can be connected firmly and quickly with a coaxial cable and prevent water from penetrating into.

(2) Description of the Prior Art

In wire TV system, close-circuit TV system or community antenna TV system, we need to use coaxial cable for transmitting signals, accordingly, the quality of end connector for coaxial cable will effect the quality of transmitting signals, especially the end connector for coaxial cable installed outdoors may be broken by the sun light or the rains to cause poor signals or interrupted signals. The conventional end connector for coaxial cable 10, such as shown in FIG. 1 is composed of a clamping tool to clamp the end of the clamping tube 11 as to connect the coaxial cable 13 inserted into the clamping tube, furthermore, some kind of the clamping tube having radial grooves formed at its inner surface so as to increase the friction force between the end connector for coaxial cable 10 and the coaxial cable 13. But the conventional end connector for coaxial cable 10 usually can't be connected firmly with coaxial cable by clamping the clamping tube 11, such that, the rains or water may penetrate into the end connector for coaxial cable from the connecting position and cause unclear image or signal interruption.

SUMMARY OF THE INVENTION

It is therefore the main object of this invention to provide a end connector for coaxial cable having an outer sleeve and a taper jacket, the taper jacket being installed at outside of the outer sleeve, as pressing the taper jacket, its taper hole will press the outer sleeve to form a conical shape to clamp firmly and quickly a coaxial cable and prevent water from penetrating into from the connecting position.

It is still another embodiment of this invention to provide a end connector for coaxial cable having a taper jacket in various color, such that, the operator can distinguish the standards or specification of coaxial cable to save assembling time or present the operator from assembling wrong standards or specification of coaxial cable to cause poor signals.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENT

Figure 1:
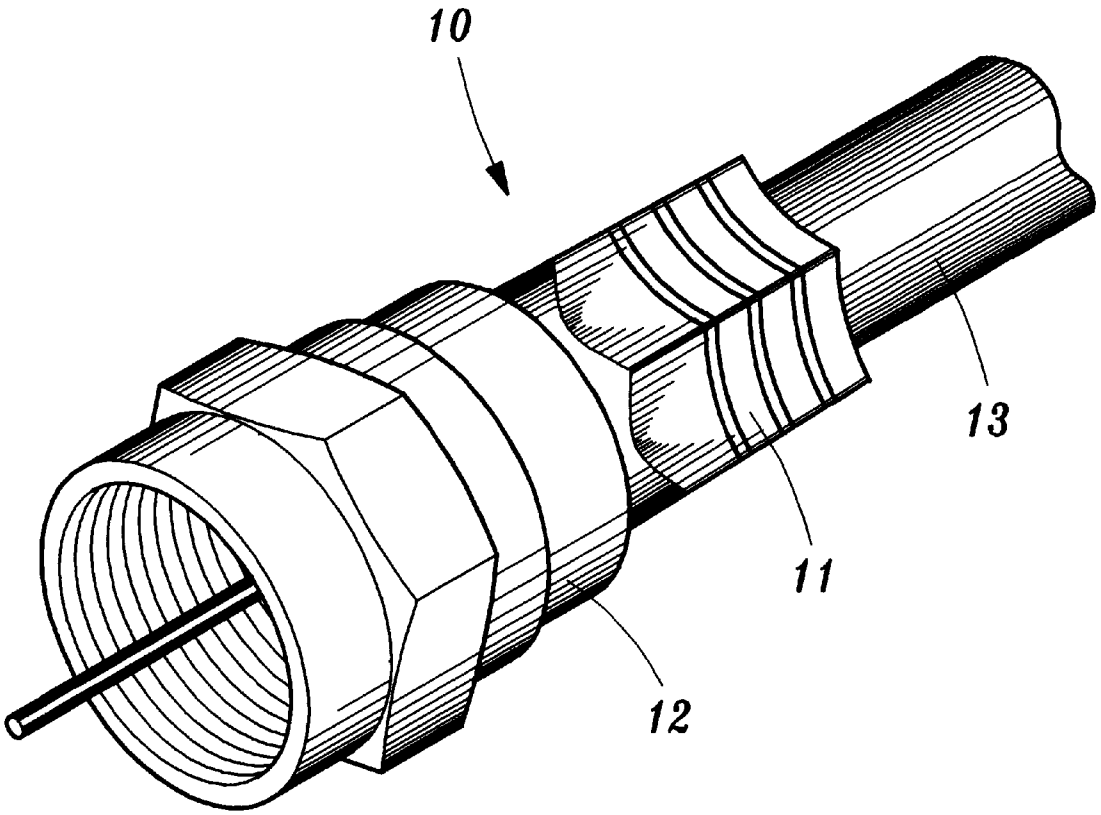
FIG. 1 PRIOR ART
FIG. 1 is a perspective view of a conventional end connector for coaxial cable.
Figure 2:
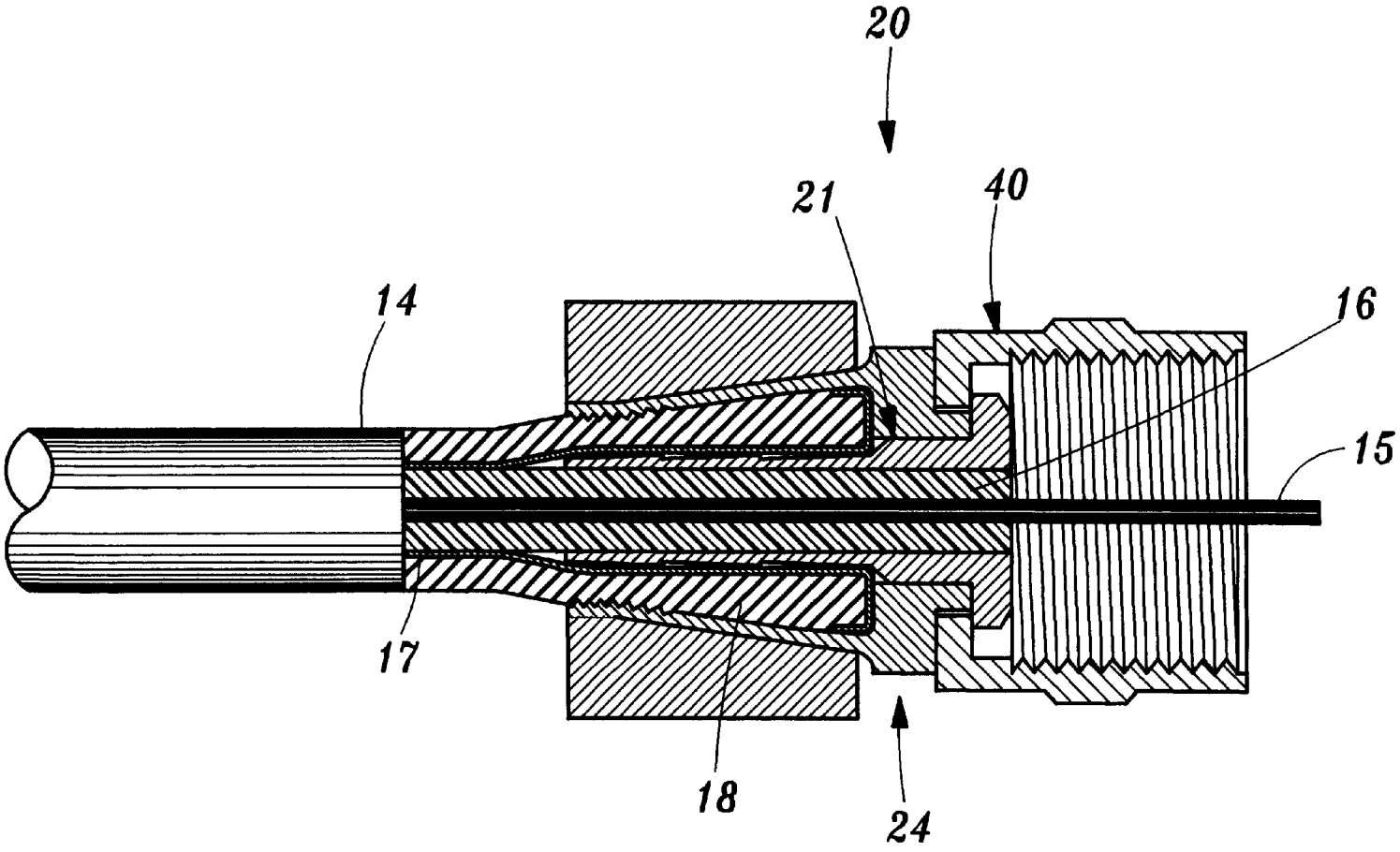
FIG. 2 is a partial sectional view showing a end connector for coaxial cable of my present invention which is connected with the coaxial cable.

Referring to FIG. 2, the conventional coaxial cable 14 is composed of a conductor 15, an insulating layer 16, a fabric layer 17 and an outer layer 18. In order to make the coaxial cable 14 can be connected firmly with a receiver or a terminal, the end of outer layer 18 should be peeled to make the fabric layer 17 cover on the outer layer 18.

Figure 3:
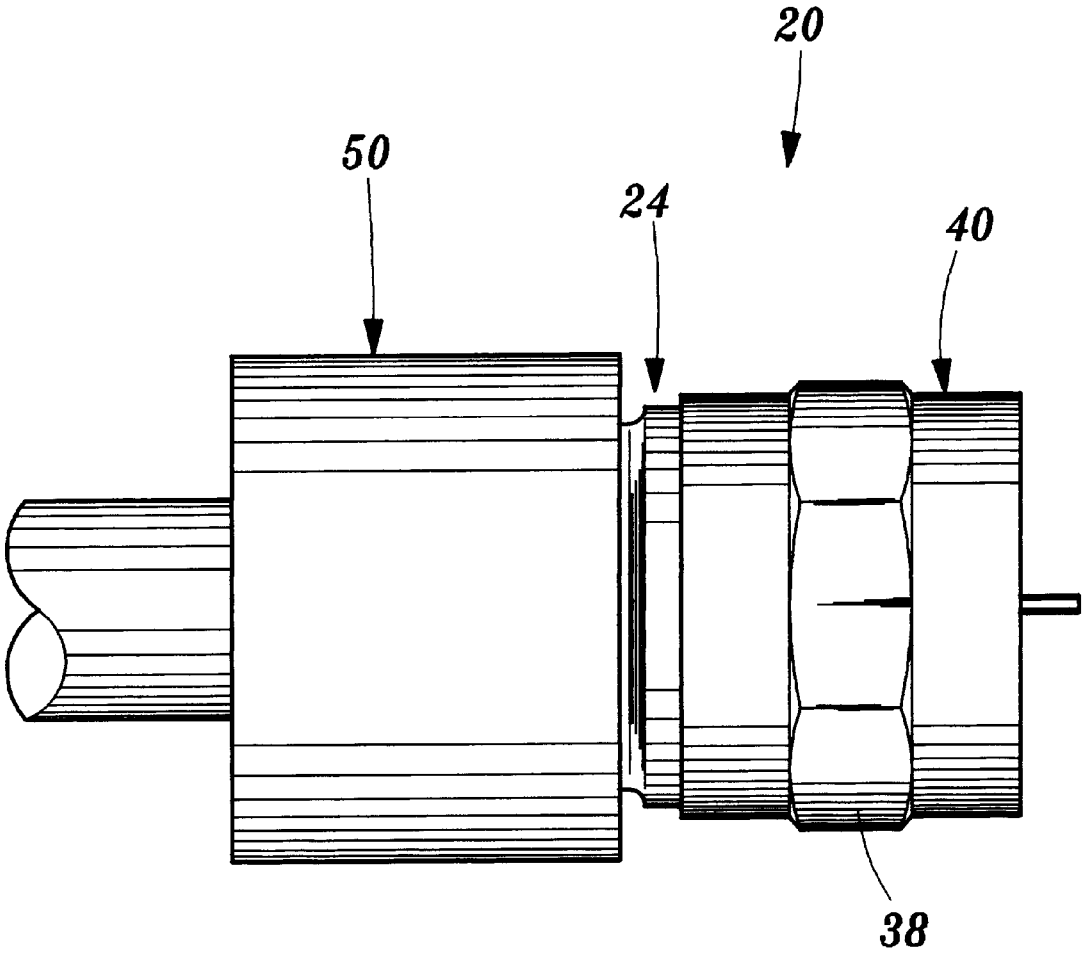
FIG. 3 is a top view of the present end connector for coaxial cable.
Figure 4:
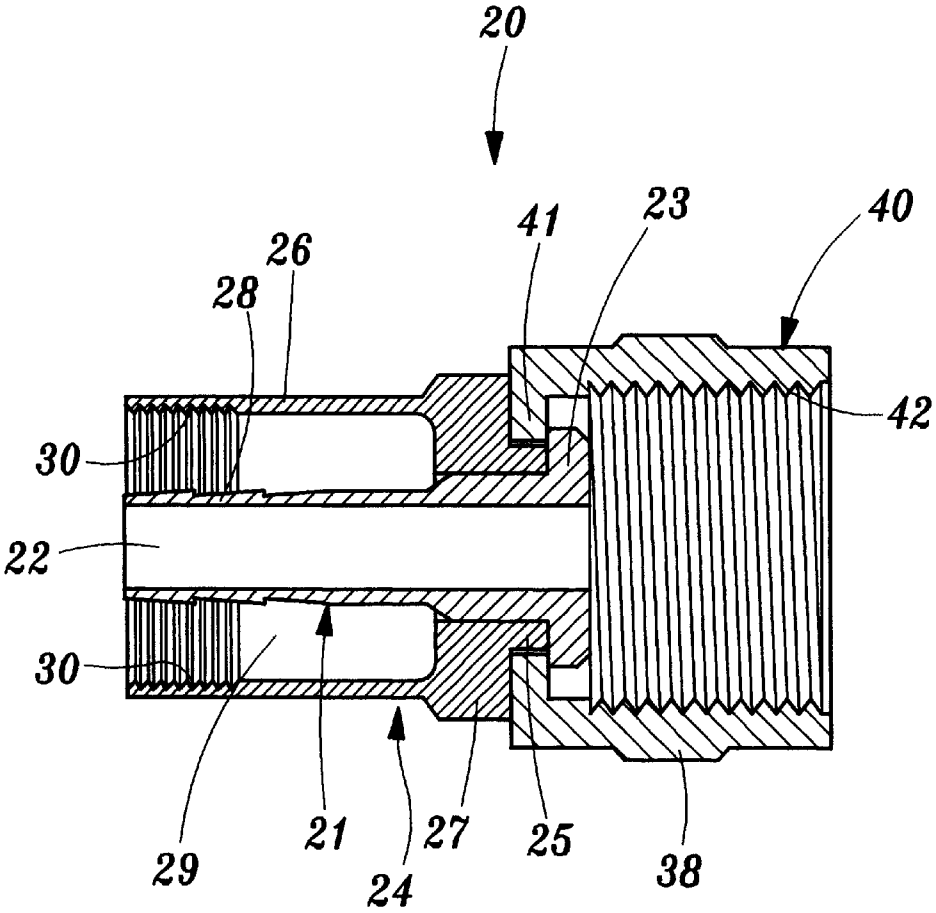
FIG. 4 is a partial sectional view showing the connection of an outer sleeve and a grip nut of this invention.
Figure 5:
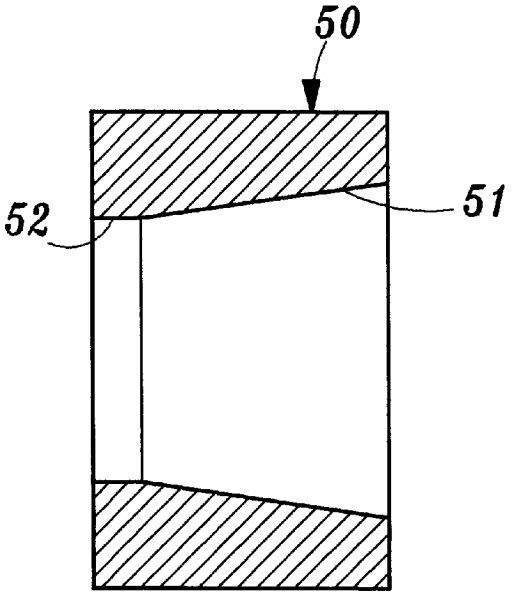
FIG. 5 is a sectional view showing a taper jacket of this invention.

The FIG. 3, FIG. 4 and FIG. 5 shows a end connector for coaxial cable of my present invention, the end connector for coaxial cable 20 is composed of a thimble 21, an outer sleeve 24, a grip nut 40 and a taper jacket 50, the thimble 21 having a through hole 22 and a first flange 23, the rear end of this thimble 21 having first extension part 28.

The outer sleeve 24 having a second flange 25, a second extension part 26 and a body 27, wherein the inner circumference of the second flange 25 being fitted with the outer thimble 21, furthermore, the wall thickness of the second extension part 26 being thinner than that of the body 27, such that, between the first extension part 28 of the thimble 21 and the second extension part 26 of the outer sleeve 24 can form a cylindrical cavity 29. The inner circumference of the second extension part 26 have a plurality of engaging teeth 30 for engaging the outer layer of coaxial cable.

The front end of this end connector coaxial cable 20 is fitted with a grip nut 40, one end of the grip nut 40 having an inserting part 41 situated between the first flange 23 of thimble 21 and the body 27 of outer sleeve 24 and can be rotated freely. The grip nut 40 has a female thread 42 formed at its inner surface and a nut flange 38 formed at its outer surface for rotating the grip nut 40 with a spanner to connect to a receiver or a terminal, such as shown in FIG. 4.

The second extension part 26 of this outer sleeve 24 is fitted with a taper jacket 50, the taper jacket having a taper hole 51 formed therein, end of the taper hole 51 is connected with a circular hole 52. As the operator press the taper jacket 50 downwardly, the taper hole 51 would press the second extension part 26 to form a conical shape, such that, the taper jacket 50 can be connected firmly with the second extension part 26, furthermore, the engaging teeth 30 in the second extension part 26 can be engaged firmly with the outer layer 18 of coaxial cable. Such as shown in FIG. 2. Accordingly, the end connector for coaxial cable 20 can be connected firmly and quickly with the coaxial cable, furthermore, the end connector for coaxial cable 20 can prevent water from penetrating into.

In addition, the taper jacket 50 can be made into various colors so as to indicate the standards of coaxial cable. Accordingly, the operator can distinguish easily the specification of coaxial cable when he assembles these coaxial cables with end connector for coaxial cable to save assembling time or present the operator from assembling wrong standards or specification of coaxial cable to cause poor signals.

The FIG. 6 to FIG. 9 shows another embodiment of this invention, the embodiment showing a end connector for coaxial cable similar to the first embodiment. The outer sleeve 60 of the another embodiment have a center hole 66 and a groove 62 formed at its front body 61, furthermore, the outer sleeve 60 having a rear extension part 63, the wall thickness of the rear extension part 63 is thinner than that of the front body 61, the rear extension part 63 having a raised part 64 formed at its outer circumference and a plurality of engaging teeth 65 formed at its inner circumference.

The rear extension part 63 of this outer sleeve 60 in FIG. 6 to FIG. 9 is fitted with a clamping jacket 70, the inner circumference of this clamping jacket 70 having a plurality of convex strips 71 and a concave groove 72, the outer end of each convex strip 71 being formed into a leading face 73, furthermore, behind the concave groove 72 having a first step hole 74, a taper hole 75 and a second step hole 76 formed at the inner circumference of this clamping jacket 70. At two sides of each convex strip 72 having at least one or more flutes 77 so as to make the convex strips 71 have sufficient elasticity. As the operator assembling the outer sleeve 60 and the clamping jacket 70 with a specific tool, the convex strips 71 will slide into the groove 62 of outer sleeve 60 by means of its elasticity.

Figure 8:
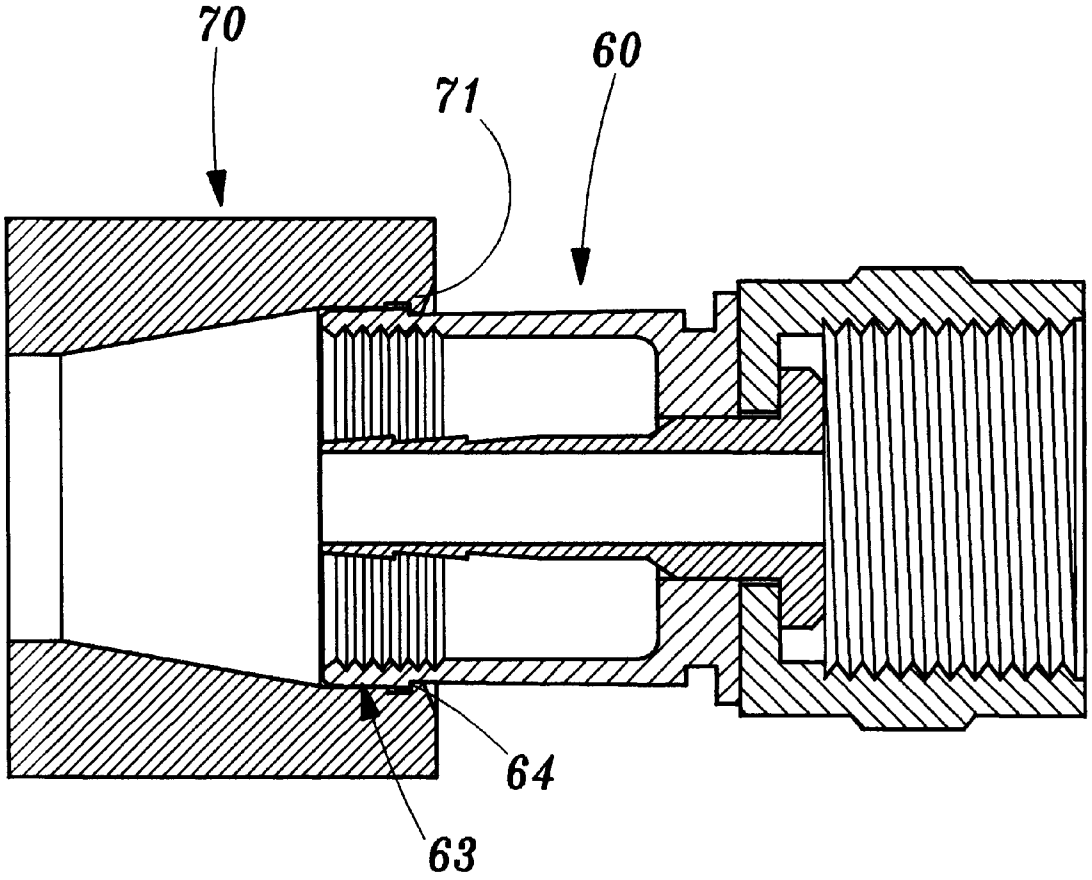
FIG. 8 is a partial view showing a taper jacket in FIG. 7A which is pre-assembled with the outer sleeve in the another embodiment.
Figure 9:
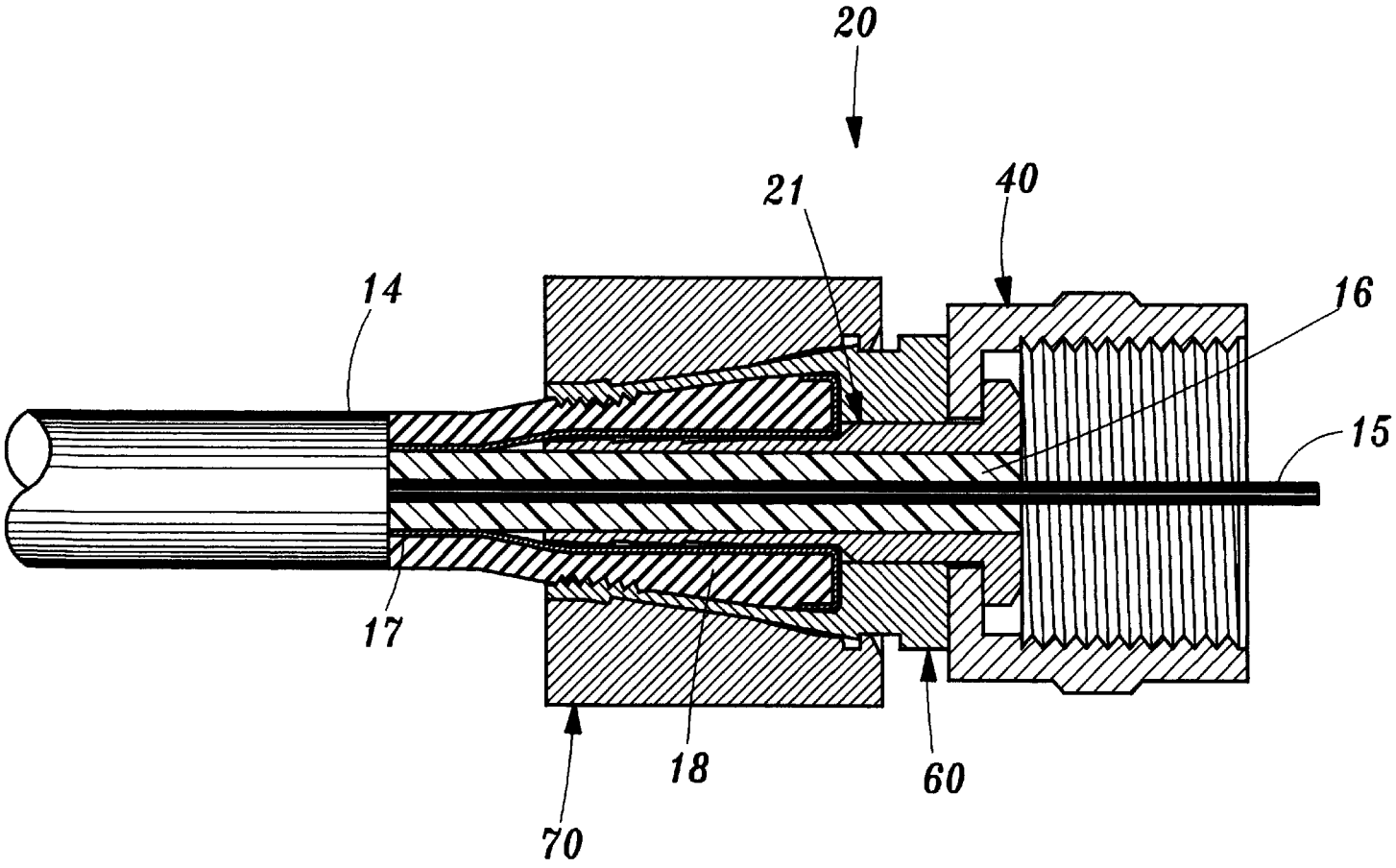
FIG. 9 is a partial sectional view showing the coaxial cable terminal of the another embodiment in FIG. 6 which is connected with a coaxial cable.

Referring to FIG. 8, before connecting the end connector for coaxial cable to a coaxial cable, the operator can assemble the outer sleeve 60 and the clamping jacket 70 in advance, the clamping jacket 70 can be connected with the outer sleeve 60 by means of retaining the convex strips 71 on the raised part 64 of the outer sleeve 60.

Figure 10:
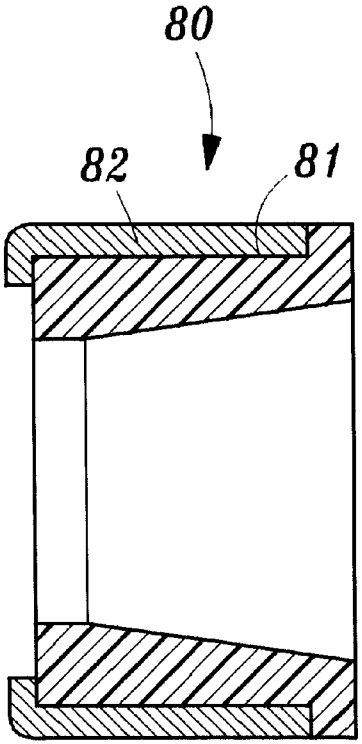
FIG. 10 is a partial sectional view showing the third embodiment of this invention.

The FIG. 10 shows the third embodiment of this invention, this taper jacket 80 in FIG. 10 is similar to the taper jacket 50 in FIG. 5 but having a step part 81 formed at its outer circumference, the step part 81 being fitted with a reducing sleeve 82 so as to reduce the wall thickness of this taper jacket 80.

Figure 6:
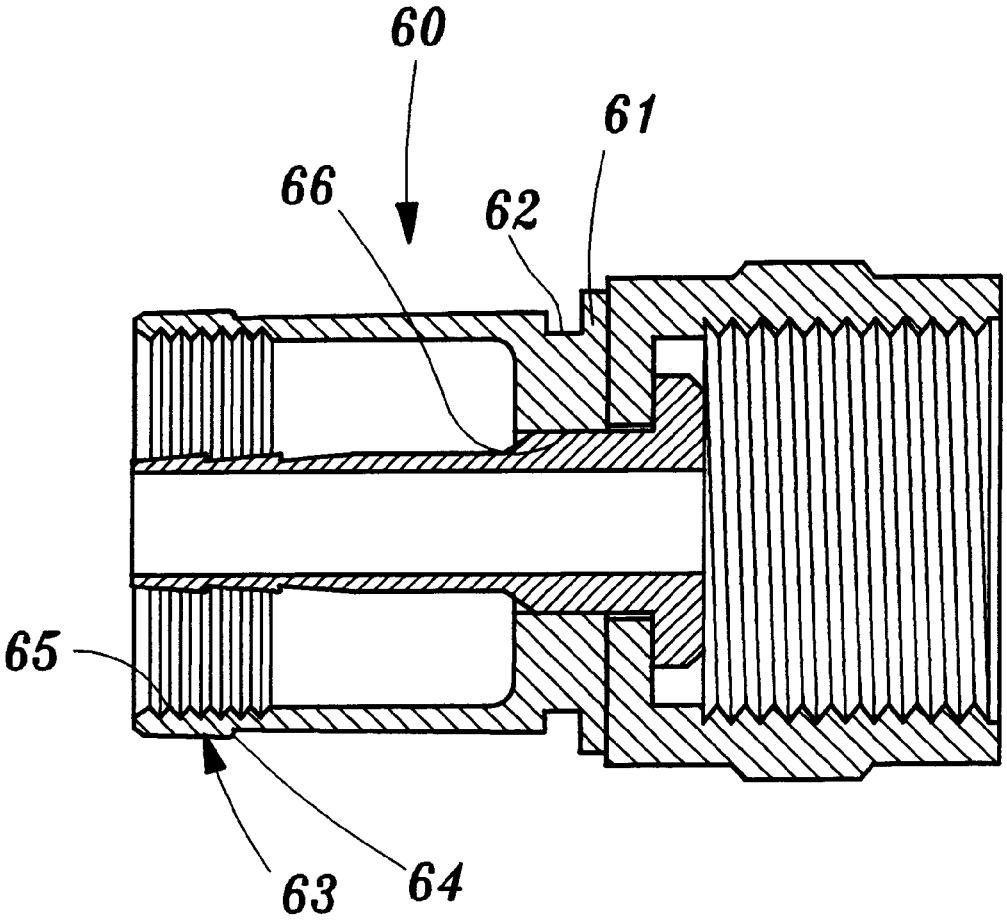
FIG. 6 is a partial sectional view showing the connection of an outer sleeve and a grip nut of another embodiment of this invention.
Figure 7B:
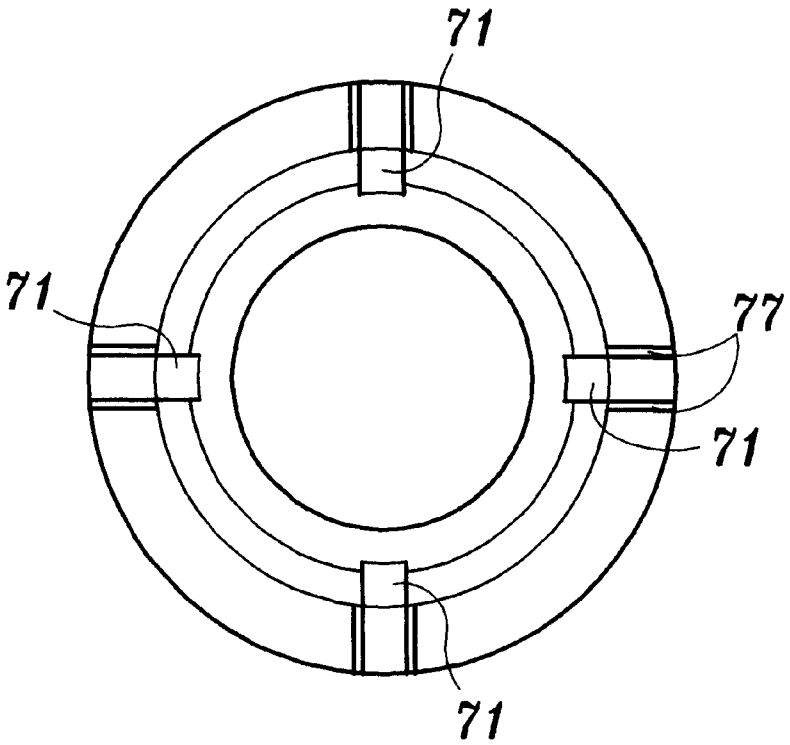
FIG. 7B is a side plan view showing the taper jacket in FIG. 7A.
Figure 7A:
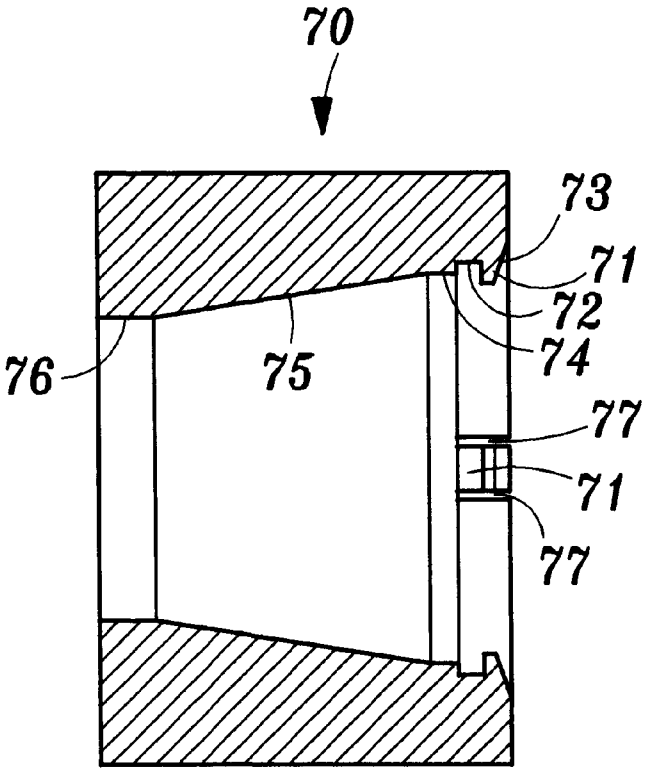
FIG. 7A is a sectional view showing a taper jacket of the embodiment in FIG. 6.
Figure 11:
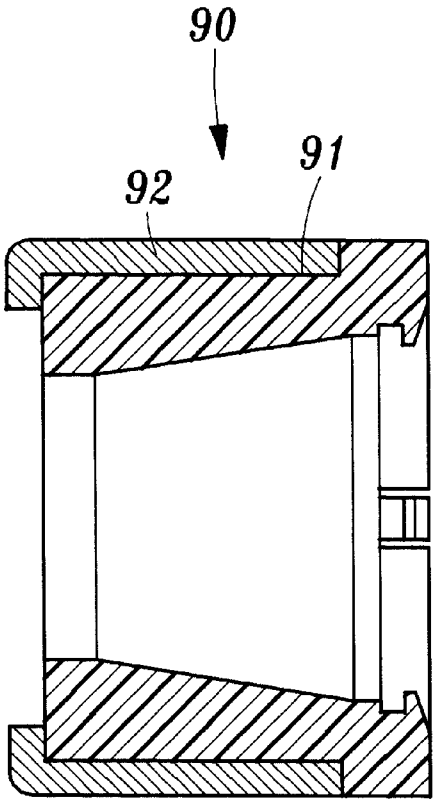
FIG. 11 is a partial sectional view showing the fourth embodiment of this invention.

The FIG. 11 shows the fourth embodiment of this invention, this clamping jacket 90 is similar to the clamping jacket 60 in FIG. 6 but having a reduce step part 91 formed at its outer circumference, the reduce step part 91 being fitted with a second reducing sleeve 92 so as to reduce the thickness of this clamping jacket 90.

It is understood by those skilled in the art that the foregoing description is a preferred embodiment of the disclosed device and that various changes and modifications may be made in the invention without departing from the spirit and scope thereof.

What is claimed is:

1. An end connector for coaxial cable comprising:

a coaxial cable which comprises a conductor, an insulating layer, a fabric layer and an outer layer, an end of said outer layer is peeled away so that said fabric layer covers said outer layer; a thimble having a through hole and a first flange, an end of said thimble being a first extension part: a grip nut, one end of said grip nut having an inserting part, said grip nut having a female thread formed at its inner circumference and a nut flange formed at its outer circumference; an outer sleeve and a taper jacket; wherein said outer sleeve is installed outside of said thimble and has a body and a second extension part, between said second extension part of said outer sleeve and said first extension part of thimble a cylindrical cavity is defined, furthermore, said taper jacket is installed at said first extension part and has an inner circumference of said taper jacket having a plurality of convex strips and a taper hole formed therein, said taper jacket compressing said second extension part so as to form a seal on said outer layer of said coaxial cable, said outer sleeve abutting said grip nut, and where two sides of each convex strip of said taper jacket each have at least one flute.

2. An end connector for coaxial cable comprising:

a coaxial cable which comprises a conductor, an insulating layer, a fabric layer and an outer layer, an end of said outer layer is peeled away so that said fabric layer covers said outer layer; a thimble having a through hole and a first flange, an end of said thimble being a first extension part: a grip nut, one end of said grip nut having an inserting part, said grip nut having a female thread formed at its inner circumference and a nut flange at its outer circumference; an outer sleeve and a clamping jacket; wherein said outer sleeve had a body and a rear extension part, an outer circumference of said body having a groove therein, said clamping jacket is installed outside of said rear extension part, an inner circumference of said clamping jacket having a plurality of convex strips, a concave groove and a taper hole, said clamping jacket compressing said rear extension part so as to form a seal on said outer layer of said coaxial cable, said outer sleeve abutting said grip nut, and wherein two sides of each convex strip of said clamping jacket each have at least one flute.

* * * * *